US010844752B2

(12) United States Patent
Karbach et al.

(10) Patent No.: US 10,844,752 B2
(45) Date of Patent: Nov. 24, 2020

(54) EXHAUST HEAT RECOVERY SYSTEM HAVING A WORKING FLUID CIRCUIT

(71) Applicant: Robert Bosch GmbH, Stuttgart (DE)

(72) Inventors: Frank Karbach, Ludwigsburg (DE); Michael Richter, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 165 days.

(21) Appl. No.: 16/305,606

(22) PCT Filed: Apr. 12, 2017

(86) PCT No.: PCT/EP2017/058838
§ 371 (c)(1),
(2) Date: Nov. 29, 2018

(87) PCT Pub. No.: WO2017/207155
PCT Pub. Date: Dec. 7, 2017

(65) Prior Publication Data

US 2020/0284168 A1 Sep. 10, 2020

(30) Foreign Application Priority Data

May 30, 2016 (DE) ..... 10 2016 209 276

(51) Int. Cl.
*F01K 23/06* (2006.01)
*F01K 23/10* (2006.01)
*F01N 5/02* (2006.01)

(52) U.S. Cl.
CPC ..... *F01K 23/065* (2013.01); *F01K 23/10* (2013.01); *F01N 5/02* (2013.01); *F01N 2240/02* (2013.01)

(58) Field of Classification Search
CPC ..... F01K 23/065; F01K 23/10; F02G 5/02; F01N 5/02; F01N 2240/02
(Continued)

(56) References Cited

U.S. PATENT DOCUMENTS 7,950,230 B2 * 5/2011 Nishikawa ..... F01K 13/02 60/618
8,752,378 B2 * 6/2014 Ernst ..... F01K 23/065 60/618
(Continued)

FOREIGN PATENT DOCUMENTS

CN 208332238 U * 1/2019
CN 111006377 A * 4/2020
(Continued)

OTHER PUBLICATIONS

An English machine translation reference to Nagai (Pub. No. WO 2014/103820 A1), published on Jul. 3, 2014.*
(Continued)

*Primary Examiner* — Thai Ba Trieu
(74) *Attorney, Agent, or Firm* — Michael Best & Friedrich LLP

(57) ABSTRACT

An exhaust heat recovery system with a working fluid circuit. The exhaust heat recovery system has a heat exchanger connected in an exhaust line of an internal combustion engine. The heat exchanger is a part of the working fluid circuit together with at least one expansion machine, a condenser, and a fluid pump. The exhaust heat recovery system has a protective device. The protective device protects the exhaust heat recovery system against a leakage amount of the working fluid escaping from the working fluid circuit and igniting. The protective device has a reservoir which stores a medium. The reservoir is a gas reservoir and the medium is a gas.

10 Claims, 1 Drawing Sheet

(58) Field of Classification Search
USPC ..... 60/618, 615, 614, 286, 320–323
See application file for complete search history.

(56) References Cited

U.S. PATENT DOCUMENTS

| | | | | |
|---|---|---|---|---|
| 2007/0175212 | A1* | 8/2007 | Uno | F01K 25/04 60/618 |
| 2012/0036850 | A1 | 2/2012 | Ernst et al. | |
| 2017/0130612 | A1* | 5/2017 | Andersson | F01K 23/065 |
| 2017/0138221 | A1* | 5/2017 | Andersson | F01K 23/065 |
| 2019/0048749 | A1* | 2/2019 | Scholz | F01K 23/065 |
| 2020/0232673 | A1* | 7/2020 | Kozasa | F24F 12/003 |

FOREIGN PATENT DOCUMENTS

| | | | |
|---|---|---|---|
| CN | 201373984 U | * | 4/2020 |
| DE | 102013211875 | | 1/2015 |
| WO | 2014103820 | | 7/2014 |

OTHER PUBLICATIONS

International Search Report for Application No. PCT/EP2017/058838 dated Jul. 7, 2017 (English Translation, 2 pages).

* cited by examiner

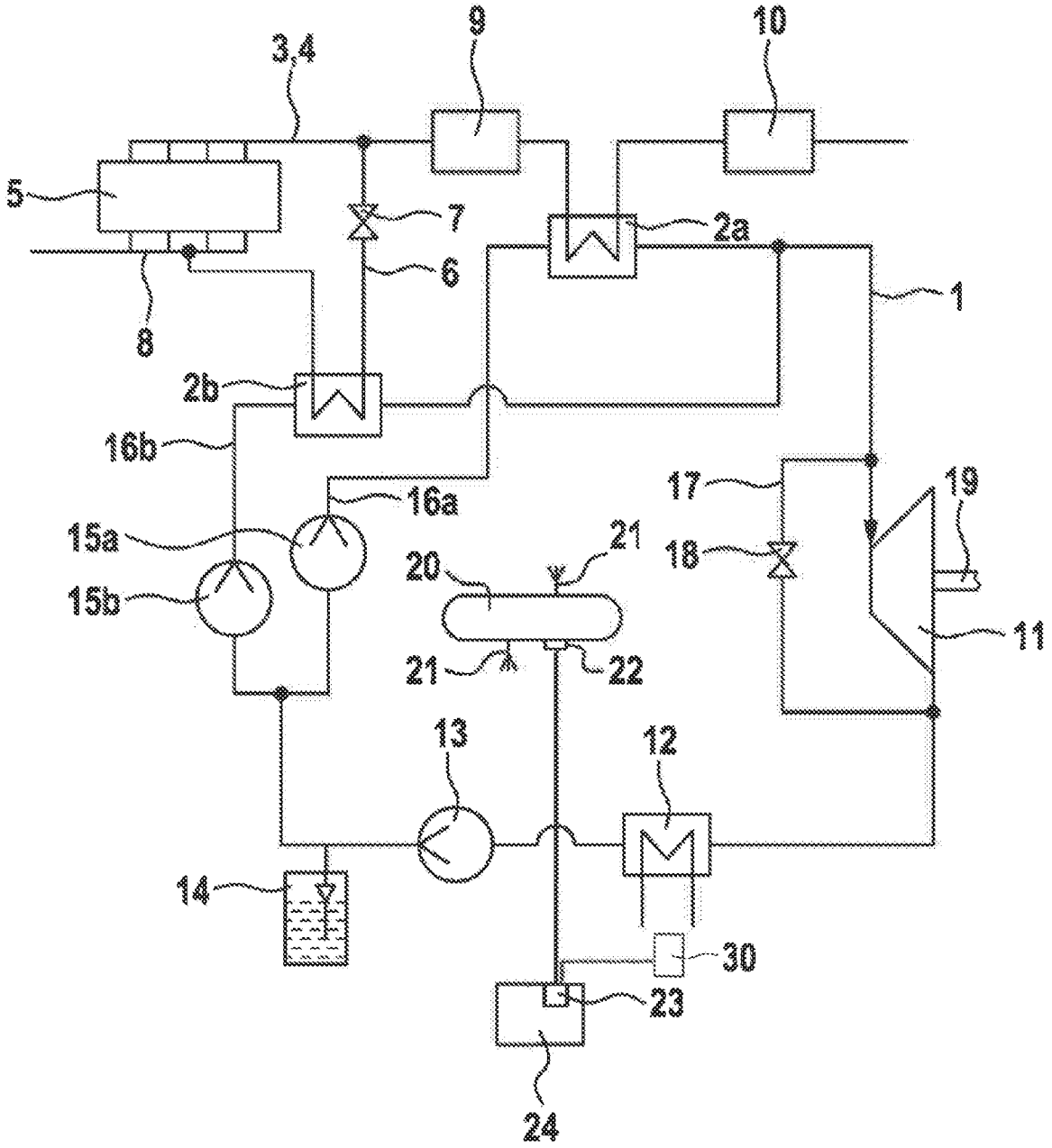
3,4
9
10
5
7
2a
6
1
8
2b
16b
17
19
16a
15a
21
18
20
15b
11
21
22
13
12
14
30
23
24

EXHAUST HEAT RECOVERY SYSTEM HAVING A WORKING FLUID CIRCUIT

BACKGROUND OF THE INVENTION

The present invention concerns an exhaust heat recovery system having a working fluid circuit, comprising a heat exchanger connected in an exhaust gas line of an internal combustion engine, wherein the heat exchanger is part of the working fluid circuit together with at least one expansion machine, a condenser and a fluid pump.

Such an exhaust heat recovery system is known from DE 10 2013 211 875 A1. This exhaust heat recovery system has a working fluid circuit with two heat exchangers, wherein a first heat exchanger is arranged in an exhaust gas line of the internal combustion engine, and a second heat exchanger in an exhaust gas recirculation line of the internal combustion engine. The working fluid circuit furthermore comprises an expansion machine, a condenser and a fluid pump, wherein downstream of the fluid pump, the working fluid circuit is divided into the two fluid branches which lead to the first heat exchanger and the second heat exchanger respectively. Firstly, a distribution valve is placed in the fluid branches which sets the quantity of working fluid supplied to the heat exchangers. When the internal combustion engine is installed in a vehicle, the exhaust heat recovery system configured in this way is normally fitted in an engine bay of the vehicle containing the internal combustion engine.

SUMMARY OF THE INVENTION

The invention is based on the object of providing an exhaust heat recovery system which is improved in relation to the known systems.

This object is achieved in that the exhaust heat recovery system has a protective device. This protective device is generally configured in arbitrary fashion and designed for general protection of the exhaust heat recovery system.

In a refinement of the invention, the protective device is a device which protects at least the exhaust heat recovery system from ignition of a leakage quantity of the working fluid escaping from the exhaust heat recovery system, in particular from the working fluid circuit. In the event of accident or faulty condition of the entire system, the working fluid may escape from the working fluid circuit, for example due to damage of a component of the exhaust heat recovery system, and be ignited if it comes into contact with a high-temperature component of the internal combustion engine or of the exhaust heat recovery system. It must be considered here that the working fluid in the working fluid circuit is conducted at least in portions in a superheated gaseous state and—again in particular in the case of a combustible working fluid such as ethanol or cyclopentane—can easily be ignited or can explode.

In a refinement of the invention, the protective device has a reservoir which receives a medium. The reservoir and the medium may in principle be configured or composed in any fashion in order to prevent or smother the ignition or explosion of the working fluid. Thus the medium may for example be an extinguishing foam which emerges from the reservoir, for example via one or more nozzles, and is directed onto or aimed at the components of the exhaust heat recovery system.

In a further embodiment of the invention, the reservoir is a gas reservoir and the medium is a gas. This is the preferred embodiment in which the gas emerging from the gas reservoir when the protective device is activated reduces the temperature of the surrounding components below a critical ignition temperature, and thus prevents ignition or explosion of the working fluid. Because of the resulting lower component temperature, there is no ignition source for the basically flammable working fluid. If an inert gas is used, also the oxygen supply necessary for combustion is reduced, so no combustible mixture of air oxygen and working fluid (in any aggregate state) can form.

In a refinement of the invention, the protective device has a trigger device. This trigger device for example opens one or more valves of the reservoir through which the medium—which is preferably pressurized when present in the reservoir—can flow out.

In a refinement of the invention, the trigger device is part of a control unit of the exhaust heat recovery system and/or the internal combustion engine. The trigger device may be configured such that this is activated as required via inputs and outputs present on the control unit, and can be connected to a protective device and in some cases to additional trigger sensors.

Here, in a further embodiment of the invention, the trigger device is connected to existing sensors. These sensors may for example be existing standard sensors which—for example when the internal combustion engine is installed in a vehicle—may be sensors, e.g. in the form of acceleration sensors. However, coupling to an airbag trigger unit is also possible, or, additionally or alternatively, independent sensors which for example detect a sudden pressure fall in the working fluid circuit or determine an unexpected occurrence for example of increased ethanol concentrations in the engine bay of the vehicle.

In a refinement of the invention, the protective device is part of a decentralized exhaust heat recovery system. Such a decentralized exhaust heat recovery system is distinguished in that the individual components of the exhaust heat recovery system are arranged as required, for example in the engine bay of the vehicle, and connected via lines. Here for example, the reservoir is arranged at a central point in the engine bay, and the medium stored in the reservoir may for example be conducted specifically to the components of the exhaust heat recovery system, for example via a valve or several valves.

In a further embodiment of the invention, the protective device is part of a centralized exhaust heat recovery system. A centralized exhaust heat recovery system is distinguished in that, here, the main components of an exhaust heat recovery system are combined into one assembly, and the only connections on the assembly are those which can be connected for example to a heat exchanger arranged in the exhaust line of the internal combustion engine, and wherein connections are present for controlling the system and dissipating the energy produced.

BRIEF DESCRIPTION OF THE DRAWINGS

Further advantageous embodiments of the invention are shown in the description of the drawings, in which an exemplary embodiment shown in the FIGURE is described in more detail.

FIG. 1 is a circuit diagram of an exhaust heat recovery system configured according to the invention with a working fluid circuit and a protective device.

DETAILED DESCRIPTION

The exhaust heat recovery system shown diagrammatically in FIG. 1 has a working fluid circuit 1 with a first heat exchanger 2*a* and a second heat exchanger 2*b*, wherein in principle only a single heat exchanger or also more than two heat exchangers may be part of the exhaust heat recovery system. The heat exchangers 2*a*, 2*b* are here configured as or function as evaporators, and in an internal combustion engine 5, are designed to recover waste heat generated in operation of the internal combustion engine 5. An exhaust gas stream 4 from the internal combustion engine 5, forming a waste heat stream and conducted in an exhaust gas line 3 of the internal combustion engine, flows through the first heat exchanger 2*a*. In addition to the first heat exchanger 2*a*, the second heat exchanger 2*b* is installed in a line in the form of an exhaust gas recirculation line 6 or other heat carrier line. A part quantity of exhaust gas is taken from the exhaust gas stream 4 via the exhaust gas recirculation line 6 and supplied in controlled fashion via an exhaust gas recirculation line valve 7 to an intake system 8 of the internal combustion engine 5. The intake system 8 may preferably be configured as a charge air line system. The two heat exchangers 2*a*, 2*b* may in some cases be bypassed via heat exchanger bypass lines (not shown here) in certain operating states of the internal combustion engine 5 of a vehicle in which the internal combustion engine 5 is preferably installed. When the internal combustion engine 5 is installed in a vehicle, the internal combustion engine 5 and the exhaust heat recovery system, with the working fluid circuit 1 and the components mentioned or to be described below, are preferably installed in a engine bay of the vehicle.

In operation, the internal combustion engine 5 receives fuel and combustion air which burn in the combustion chambers of the internal combustion engine 5, generating working power as hot exhaust gas which forms the exhaust gas stream 4 in operation of the internal combustion engine 5. The exhaust gas stream 4 is finally discharged through the exhaust gas line 3, from which the exhaust gas recirculation line 6 also branches, to the environment. Exhaust silencers 9 and devices 10 for after-treatment of the exhaust gas, for example in the form of a catalytic converter and/or a filter, may be installed in the exhaust gas line 3 upstream and/or downstream of the first heat exchanger 2*a*, in any order. The internal combustion engine 5 is for example a self-igniting internal combustion engine operated on diesel fuel. The diesel fuel is here for example injected into the combustion chambers by means of a common rail injection system (not shown). The internal combustion engine may however also be an externally ignited, petrol-operated internal combustion engine which may also have a common rail injection system.

The first heat exchanger 2*a* and the second heat exchanger 2*b*, as stated above, are each part of the working fluid circuit 1 which comprises, in addition to the heat exchangers 2*a*, 2*b*, an expansion machine 11, a condenser 12, in some cases a condenser pump 13, an expansion tank 14, and one or two fluid pumps 15*a*, 15*b*. The fluid pump 15*a* is fluidically connected via a first supply line 16*a* to the first heat exchanger 2*a*, and the second fluid pump 15*b* is fluidically connected via a second supply line 16*b* to the second heat exchanger 2*b*. The fluid pumps 15*a*, 15*b* may be autonomous pumps, or for example be designed in the form of a double-stroke vane pump. For example, a double-stroke vane pump can be set such that, with a constant or adjustable total delivery quantity of the working fluid, the division of delivery quantity to the first heat exchanger 2*a* and the second heat exchanger 2*b* can be set increasingly—and accordingly decreasingly—between 0% and 100%. The total delivery quantity may for example be set by changing the rotation speed of the fluid pumps 15*a*, 15*b*. As indicated above however, also only one single fluid pump 15 may be present, wherein then control valves are fitted in the first supply line 16*a* and in the second supply line 16*b* in order to set the distribution of the delivery quantity. If only a single heat exchanger is provided, naturally the delivery quantity distribution described above is not required.

The expansion machine 11 may for example be a piston machine or a turbine. In the case of a turbine, normally a reduction gear is fitted downstream in order to reduce the high turbine rotation speeds and adapt these to the rotation speeds of a downstream working machine or other consumer.

In operation of the exhaust heat recovery system, the fluid pumps 15*a*, 15*b* pressurize a fluid suitable for a Rankine process, for example ethanol or cyclopentane, to a high pressure and supply it to the heat exchangers 2*a*, 2*b*. The fluid is heated in the heat exchangers 2*a*, 2*b* and transferred into the gaseous state under high pressure. The resulting vapor is supplied to the expansion machine 11 and drives this under expansion of the working fluid. In order to conduct the working fluid circuit 1 past the expansion machine 11, a bypass line 17 may be provided with a bypass valve 18, via which the expansion machine 11 can be bypassed.

The working fluid supplied to the expansion machine 11 expands here, performing mechanical shaft work which is discharged via an output shaft. The output shaft 19 may for example be coupled to a generator to generate electrical power. Then the "cold" vapor is condensed in a condenser 12 and finally returned to the fluid pumps 15*a*, 15*b*. The expansion tank 14 is connected in the connecting line between the condenser 12 and the double-stroke vane pump 13. As well as the above-mentioned components, arbitrary further components may be provided, in particular sensors for determining temperatures and pressures in various portions of the working fluid circuit 1. Furthermore, a control unit is present for controlling the exhaust heat recovery system.

According to the invention, the exhaust heat recovery system has a protective device which may reliably prevent the ignition of a leakage quantity of the working fluid escaping from the working fluid circuit 1. For this, the protective device has a reservoir formed as a gas reservoir 20, in which a medium is stored in the form of a pressurized gas. Any number of nozzles 21 may be connected directly or via nozzle lines to the gas reservoir 20, and directed at various regions of the working fluid circuit 1. Furthermore, the gas reservoir 20 has a control connection 22 for a trigger device 23, which may be part of a control unit 24 of the exhaust heat recovery system. The control unit 24 or the trigger device 23 is connected to sensors 30 which respond for example in the event of a vehicle crash or airbag deployment, or on detection of a suddenly rising concentration of the working fluid in the engine bay. If such a state is determined, the protective device is activated and the nozzles 21 of the gas reservoir 20 open, so that the gas present in the gas reservoir 20 can flow out and for example reduce the temperature of surrounding components of the working fluid circuit 12 below a critical ignition temperature. This prevents ignition or explosion of the leakage quantity of the working fluid. The gas reservoir 20 may also be provided with a filling device for the gas.

What is claimed is:

1. A vehicle system comprising:

an internal combustion engine;

an exhaust heat recovery system; and a protective device, wherein the exhaust heat recovery system further comprises a working fluid circuit (1), having a heat exchanger (2*a*) connected in an exhaust gas line (3) of the internal combustion engine (5);

at least one expansion machine (11);

a condenser (12); and a fluid pump (15*a*); and wherein the protective device further includes:

a reservoir (20); and a plurality of nozzles (21) fluidly connected to the reservoir (20), positioned relative to the exhaust heat recovery system and controlled by a control unit (24) to spray a medium contained within the reservoir (20) onto the working fluid circuit when a fault condition is detected by at least one existing sensor (30).

2. The vehicle system as claimed in claim 1, wherein the protective device protects the exhaust heat recovery system from ignition of by smothering a leakage quantity of the working fluid escaping from the exhaust heat recovery system.

3. The vehicle system as claimed in claim 2, wherein the protective device protects the exhaust heat recovery system from ignition by smothering a leakage quantity of the working fluid escaping from the exhaust heat recovery system via the working fluid circuit (1).

4. The vehicle system as claimed in claim 1, wherein the medium is a pressurized gas.

5. The vehicle system as claimed in claim 4, wherein the pressurized gas is an extinguishing foam.

6. The vehicle system as claimed in claim 5, wherein the control unit (24) of the protective device further includes a trigger device (23) being connected to the at least one existing sensor (30) to control the medium flowing out of the reservoir.

7. The vehicle system as claimed in claim 6, wherein at least one existing sensor (30) detects at least one of a vehicle crash, airbag deployment, and concentration of working fluid.

8. The vehicle system as claimed in claim 1, wherein the control unit (24) of the protective device further includes a trigger device (23) being connected to the at least one existing sensor (30) to control the medium flowing out of the reservoir.

9. The apparatus as claimed in claim 8, characterized in that the trigger device (23) is connected to existing sensors (30) configured to detect the fault condition.

10. The vehicle system as claimed in claim 9, wherein the fault condition includes at least one of a vehicle crash, airbag deployment, and concentration of working fluid.

* * * * *